US006379196B1

(12) United States Patent
Greenberg et al.

(10) Patent No.: US 6,379,196 B1
(45) Date of Patent: Apr. 30, 2002

(54) TERMINAL CONNECTOR FOR A CIRCUIT BREAKER

(75) Inventors: Randy Greenberg, Granby; David Arnold, Chester; Roger N. Castonguay, Terryville; Dave Christensen, Harwinton, all of CT (US); Matthias Reichard, Neumunster (DE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/516,449

(22) Filed: Mar. 1, 2000

(51) Int. Cl.[7] ..... H01R 4/30
(52) U.S. Cl. ..... 439/801; 335/202
(58) Field of Search ..... 439/801, 810; 361/634; 335/202; 403/21, 22, 4; 411/119

(56) References Cited

U.S. PATENT DOCUMENTS

| | | | | | |
|---|---|---|---|---|---|
| 2,340,682 | A | * | 2/1944 | Powell | 200/147 |
| 2,719,203 | A | * | 9/1955 | Gelzheiser et al. | 200/144 |
| 2,931,006 | A | | 3/1960 | Klumpp, Jr. | 439/710 |
| 2,937,254 | A | * | 5/1960 | Ericson | 200/114 |
| 3,099,730 | A | | 7/1963 | Tateishi | 335/131 |
| 3,158,717 | A | * | 11/1964 | Jencks et al. | 200/116 |
| 3,162,739 | A | * | 12/1964 | Klein et al. | 200/88 |
| 3,197,582 | A | * | 7/1965 | Norden | 200/50 |
| 3,307,002 | A | * | 2/1967 | Cooper | 200/116 |
| 3,517,356 | A | * | 6/1970 | Hanafusa | 335/16 |
| 3,631,369 | A | * | 12/1971 | Menocal | 337/110 |
| 3,803,455 | A | * | 4/1974 | Willard | 317/33 SC |
| 3,883,781 | A | * | 5/1975 | Cotton | 317/14 R |
| 4,055,737 | A | | 10/1977 | Rasmussen | |
| 4,129,762 | A | * | 12/1978 | Bruchet | 200/153 G |

(List continued on next page.)

FOREIGN PATENT DOCUMENTS

| | | |
|---|---|---|
| BE | 819 008 A | 12/1974 |
| BE | 897 691 A | 7/1984 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |

(List continued on next page.)

*Primary Examiner*—Neil Abrams
*Assistant Examiner*—Javaid Nasri
(74) *Attorney, Agent, or Firm*—Cantor Colburn LLP; Carl B. Horton

(57) ABSTRACT

A termination connector for a circuit breaker is disclosed. The termination connector preferably includes a plurality of single pole screw receiving members integrally attached by a molded housing for unitary attachment to a line or load end of a circuit breaker to assist in holding a nut or nut plate adjacent each screw hole in the circuit breaker's terminal straps. The molded housing preferably includes a line of perforations between each single pole screw receiving member so that the correct number of single pole screw receiving members can be retained and the others can be knocked off along the line of perforations. Provisions are disclosed for adaption of the connector to metric or English standard nut hardware. In addition, the termination connector and circuit breaker are provided with mating attachment devices for providing a simple yet secure connection.

42 Claims, 6 Drawing Sheets

U.S. PATENT DOCUMENTS

| | | | | | |
|---|---|---|---|---|---|
| 4,144,513 | A | * | 3/1979 | Shafer et al. | 335/46 |
| 4,158,119 | A | * | 6/1979 | Krakik | 200/240 |
| 4,165,453 | A | * | 8/1979 | Hennemann | 200/153 G |
| 4,166,988 | A | * | 9/1979 | Ciarcia et al. | 335/9 |
| 4,220,934 | A | * | 9/1980 | Wafer et al. | 335/16 |
| 4,255,732 | A | * | 3/1981 | Wafer et al. | 335/16 |
| 4,259,651 | A | * | 3/1981 | Yamat | 335/16 |
| 4,263,492 | A | * | 4/1981 | Maier et al. | 200/288 |
| 4,276,527 | A | * | 6/1981 | Gerbert-Gaillard et al. | 335/39 |
| 4,297,663 | A | * | 10/1981 | Seymour et al. | 335/20 |
| 4,301,342 | A | * | 11/1981 | Castonguay et al. | 200/153 SC |
| 4,360,852 | A | * | 11/1982 | Gilmore | 361/98 |
| 4,368,444 | A | * | 1/1983 | Preuss et al. | 335/166 |
| 4,370,018 | A | | 1/1983 | Lane, III | |
| 4,375,021 | A | * | 2/1983 | Pardini et al. | 200/147 B |
| 4,375,022 | A | * | 2/1983 | Daussin et al. | 200/148 R |
| 4,376,270 | A | * | 3/1983 | Staffen | 335/21 |
| 4,383,146 | A | * | 5/1983 | Bur | 200/17 R |
| 4,392,036 | A | * | 7/1983 | Troebel et al. | 200/322 |
| 4,393,283 | A | | 7/1983 | Masuda | 200/51.09 |
| 4,401,872 | A | | 8/1983 | Boichot-Catagne et al. | 200/153 G |
| 4,409,573 | A | | 10/1983 | DiMarco et al. | 335/16 |
| 4,435,690 | A | | 3/1984 | Link et al. | 335/37 |
| 4,467,297 | A | | 8/1984 | Boichot-Castagne et al. | 335/8 |
| 4,468,645 | A | | 8/1984 | Gerbert-Gaillard et al. | 335/42 |
| 4,470,027 | A | | 9/1984 | Link et al. | 335/16 |
| 4,479,143 | A | | 10/1984 | Watanabe et al. | 358/44 |
| 4,488,133 | A | | 12/1984 | McClellan et al. | 335/16 |
| 4,492,941 | A | | 1/1985 | Nagel | 335/13 |
| 4,541,032 | A | | 9/1985 | Schwab | 361/331 |
| 4,546,224 | A | | 10/1985 | Mostosi | 200/153 G |
| 4,550,360 | A | | 10/1985 | Dougherty | 361/93 |
| 4,562,419 | A | | 12/1985 | Preuss et al. | 335/195 |
| 4,589,052 | A | | 5/1986 | Dougherty | 361/94 |
| 4,595,812 | A | | 6/1986 | Tamaru et al. | 200/307 |
| 4,611,187 | A | | 9/1986 | Banfi | 335/16 |
| 4,612,430 | A | | 9/1986 | Sloan et al. | 200/327 |
| 4,616,198 | A | | 10/1986 | Pardini | 335/16 |
| 4,622,444 | A | | 11/1986 | Kandatsu et al. | 200/303 |
| 4,631,625 | A | | 12/1986 | Alexander et al. | 361/94 |
| 4,642,431 | A | | 2/1987 | Tedesco et al. | 200/153 G |
| 4,644,438 | A | | 2/1987 | Puccinelli et al. | 361/75 |
| 4,649,247 | A | | 3/1987 | Preuss et al. | 200/244 |
| 4,658,322 | A | | 4/1987 | Rivera | 361/37 |
| 4,672,501 | A | | 6/1987 | Bilac et al. | 361/96 |
| 4,675,481 | A | | 6/1987 | Markowski et al. | 200/144 R |
| 4,682,264 | A | | 7/1987 | Demeyer | 361/96 |
| 4,689,712 | A | | 8/1987 | Demeyer | 361/96 |
| 4,694,373 | A | | 9/1987 | Demeyer | 361/96 |
| 4,710,845 | A | | 12/1987 | Demeyer | 361/96 |
| 4,717,985 | A | | 1/1988 | Demeyer | 361/96 |
| 4,733,211 | A | | 3/1988 | Castonguay et al. | 335/192 |
| 4,733,321 | A | | 3/1988 | Lindeperg | 361/96 |
| 4,764,650 | A | | 8/1988 | Bur et al. | 200/153 G |
| 4,768,007 | A | | 8/1988 | Mertz et al. | 335/202 |
| 4,780,786 | A | | 10/1988 | Weynachter et al. | 361/87 |
| 4,809,132 | A | | 2/1989 | Palmieri et al. | 361/353 |
| 4,831,221 | A | | 5/1989 | Yu et al. | 200/553 |
| 4,870,531 | A | | 9/1989 | Danek | 361/93 |
| 4,883,931 | A | | 11/1989 | Batteux et al. | 200/148 R |
| 4,884,047 | A | | 11/1989 | Baginski et al. | 335/10 |
| 4,884,164 | A | | 11/1989 | Dziura et al. | 361/97 |
| 4,900,882 | A | | 2/1990 | Bernard et al. | 200/147 R |
| 4,910,485 | A | | 3/1990 | Bolongeat-Mobleu et al. | 335/195 |
| 4,914,541 | A | | 4/1990 | Tripodi et al. | 361/94 |
| 4,916,420 | A | | 4/1990 | Bartolo et al. | 335/172 |
| 4,916,421 | A | | 4/1990 | Pardini et al. | 335/185 |
| 4,926,282 | A | | 5/1990 | McGhie | 361/102 |
| 4,935,590 | A | | 6/1990 | Malkin et al. | 200/148 A |
| 4,937,706 | A | | 6/1990 | Schueller et al. | 361/396 |
| 4,939,492 | A | | 7/1990 | Raso et al. | 335/42 |
| 4,943,691 | A | | 7/1990 | Mertz et al. | 200/151 |
| 4,943,888 | A | | 7/1990 | Jacob et al. | 361/96 |
| 4,950,855 | A | | 8/1990 | Bolonegeat-Mobleu et al. | 200/148 A |
| 4,951,018 | A | | 8/1990 | Schmiedel et al. | 335/132 |
| 4,951,019 | A | | 8/1990 | Gula | 335/166 |
| 4,952,897 | A | | 8/1990 | Barnel et al. | 335/147 |
| 4,958,135 | A | | 9/1990 | Baginski et al. | 335/8 |
| 4,965,543 | A | | 10/1990 | Batteux | 335/174 |
| 4,983,788 | A | | 1/1991 | Pardini | 200/16 R |
| 4,992,765 | A | * | 2/1991 | Hirota et al. | 335/202 |
| 5,001,313 | A | | 3/1991 | Leclerq et al. | 200/148 B |
| 5,004,878 | A | | 4/1991 | Seymour et al. | 200/144 R |
| 5,029,301 | A | | 7/1991 | Nebon et al. | 335/16 |
| 5,030,804 | A | | 7/1991 | Abri | 200/323 |
| 5,057,655 | A | | 10/1991 | Kersusan et al. | 200/148 B |
| 5,077,627 | A | | 12/1991 | Fraisse | 361/93 |
| 5,083,081 | A | | 1/1992 | Barrault et al. | 324/126 |
| 5,095,183 | A | | 3/1992 | Raphard et al. | 200/148 A |
| 5,103,198 | A | | 4/1992 | Morel et al. | 335/6 |
| 5,115,371 | A | | 5/1992 | Tripodi | 361/106 |
| 5,120,921 | A | | 6/1992 | DiMarco et al. | 200/401 |
| 5,132,865 | A | | 7/1992 | Mertz et al. | 361/6 |
| 5,138,121 | A | | 8/1992 | Streich et al. | 200/293 |
| 5,140,115 | A | | 8/1992 | Morris | 200/308 |
| 5,153,802 | A | | 10/1992 | Mertz et al. | 361/18 |
| 5,155,315 | A | | 10/1992 | Malkin et al. | 200/148 R |
| 5,166,483 | A | | 11/1992 | Kersusan et al. | 200/144 A |
| 5,172,087 | A | | 12/1992 | Castonguay et al. | 335/160 |
| 5,178,504 | A | | 1/1993 | Falchi | 411/553 |
| 5,184,717 | A | | 2/1993 | Chou et al. | 200/401 |
| 5,187,339 | A | | 2/1993 | Lissandrin | 200/148 F |
| 5,198,956 | A | | 3/1993 | Dvorak | 361/106 |
| 5,200,724 | A | | 4/1993 | Gula et al. | 335/166 |
| 5,210,385 | A | | 5/1993 | Morel et al. | 200/146 R |
| 5,239,150 | A | | 8/1993 | Bolongeat-Mobleu et al. | 200/148 R |
| 5,245,743 | A | | 9/1993 | Landy et al. | |
| 5,260,533 | A | | 11/1993 | Livesey et al. | 200/401 |
| 5,262,744 | A | | 11/1993 | Arnold et al. | 335/8 |
| 5,280,144 | A | | 1/1994 | Bolongeat-Mobleu et al. | 200/148 R |
| 5,281,776 | A | | 1/1994 | Morel et al. | 200/144 |
| 5,296,660 | A | | 3/1994 | Morel et al. | 200/146 R |
| 5,296,664 | A | | 3/1994 | Crookston et al. | 200/401 |
| 5,298,874 | A | | 3/1994 | Morel et al. | 335/8 |
| 5,310,971 | A | | 5/1994 | Vial et al. | 200/244 |
| 5,313,180 | A | | 5/1994 | Vial et al. | 335/16 |
| 5,317,471 | A | | 5/1994 | Izoard et al. | 361/105 |
| 5,331,500 | A | | 7/1994 | Corcoles et al. | 361/93 |
| 5,334,808 | A | | 8/1994 | Bur et al. | 200/50 |
| 5,341,191 | A | | 8/1994 | Crookston et al. | 335/16 |
| 5,347,096 | A | | 9/1994 | Bolongeat-Mobleu et al. | 200/148 B |
| 5,347,097 | A | | 9/1994 | Bolongeat-Mobleu et al. | 200/148 B |
| 5,350,892 | A | | 9/1994 | Rozier | 200/144 B |
| 5,357,066 | A | | 10/1994 | Morel et al. | 200/17 R |
| 5,357,068 | A | | 10/1994 | Rozier | 200/148 R |
| 5,357,394 | A | | 10/1994 | Piney | 361/72 |
| 5,361,052 | A | | 11/1994 | Ferullo et al. | 335/172 |
| 5,373,130 | A | | 12/1994 | Barrault et al. | 200/147 R |
| 5,379,013 | A | | 1/1995 | Coudert | 335/17 |
| 5,424,701 | A | | 6/1995 | Castonguary et al. | 335/172 |
| 5,438,176 | A | | 8/1995 | Bonnardel et al. | 200/400 |
| 5,440,088 | A | | 8/1995 | Coudert et al. | 200/303 |
| 5,449,871 | A | | 9/1995 | Batteux et al. | 200/401 |
| 5,450,048 | A | | 9/1995 | Leger et al. | 335/132 |

| | | | | |
|---|---|---|---|---|
| 5,451,729 | A | 9/1995 | Onderka et al. | 200/18 |
| 5,457,295 | A | 10/1995 | Tanibe et al. | 200/293 |
| 5,467,069 | A | 11/1995 | Payet-Burin et al. | 335/42 |
| 5,469,121 | A | 11/1995 | Payet-Burin | 335/16 |
| 5,475,558 | A | 12/1995 | Barjonnet et al. | 361/64 |
| 5,477,016 | A | 12/1995 | Baginski et al. | 200/43.11 |
| 5,479,143 | A | 12/1995 | Payet-Burin | 335/202 |
| 5,483,212 | A | 1/1996 | Lankuttis et al. | 335/132 |
| 5,485,343 | A | 1/1996 | Santos et al. | 361/115 |
| 5,493,083 | A | 2/1996 | Olivier | 200/17 R |
| 5,504,284 | A | 4/1996 | Lazareth et al. | 200/50 R |
| 5,504,290 | A | 4/1996 | Baginski et al. | 200/401 |
| 5,510,761 | A | 4/1996 | Boder et al. | 335/172 |
| 5,512,720 | A | 4/1996 | Coudert et al. | 200/400 |
| 5,515,018 | A | 5/1996 | DiMarco et al. | 335/16 |
| 5,519,561 | A | 5/1996 | Mrenna et al. | 361/105 |
| 5,534,674 | A | 7/1996 | Steffens | 218/154 |
| 5,534,832 | A | 7/1996 | Duchemin et al. | 335/16 |
| 5,534,835 | A | 7/1996 | McColloch et al. | 335/172 |
| 5,534,840 | A | 7/1996 | Cuingnet | 337/1 |
| 5,539,168 | A | 7/1996 | Linzenich | 200/303 |
| 5,543,595 | A | 8/1996 | Mader et al. | 200/401 |
| 5,552,755 | A | 9/1996 | Fello et al. | 335/18 |
| 5,581,219 | A | 12/1996 | Nozawa et al. | 335/132 |
| 5,604,656 | A | 2/1997 | Derrick et al. | 361/187 |
| 5,608,367 | A | 3/1997 | Zoller et al. | 335/132 |
| 5,772,479 | A | 6/1998 | Fleege et al. | 439/801 |
| 5,784,233 | A | 7/1998 | Bastard et al. | 361/36 |
| 6,144,271 | A | 8/1999 | Mueller et al. | 335/202 |

FOREIGN PATENT DOCUMENTS

| | | |
|---|---|---|
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 679324 | 1/1992 |
| EP | 0 555 158 | 8/1993 |
| EP | 0 560 697 | 9/1993 |
| EP | 0 567 416 | 10/1993 |
| EP | 3224144 | 12/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 9743778 A | 11/1997 |
| EP | 2761193 A | 9/1998 |
| EP | 0 889 498 | 1/1999 |
| EP | 0555157 B1 | 6/2000 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| RU | 1 227 978 | 4/1986 |
| WO | 92/00598 | 1/1992 |
| WO | 92/05649 | 4/1992 |
| WO | 94/00901 | 1/1994 |

* cited by examiner

TERMINAL CONNECTOR FOR A CIRCUIT BREAKER

BACKGROUND OF THE INVENTION

The present invention relates to circuit breakers, and more particularly relates to a circuit breaker device which assists in installation.

During installation of a circuit breaker, terminal straps extending from either a line side or a load side of a circuit breaker must be connected to its source or load (such as to bus lines or cable lines). Connection may be accomplished by inserting a screw, or other rod-shaped connector, through a hole in the terminal strap and through an opening in a connector for the source or load. A nut, or equivalent receiving or tightening device, may then be attached to the screw for securing the connection between the terminal strap and the source or load.

When a screw is used to make the above-described connection, holding a nut for assembly of the load/source connector to the terminal strap is awkward and labor intensive. In some instances, holding the nut by hand is practically impossible and an alternative assembly method must be selected.

Threaded terminal straps are prone to being stripped if the proper screw is not used or if it is over-torqued. If they are stripped, then the entire circuit breaker may need to be replaced (at significant expense) or an alternate fastening method may be required. Furthermore, threaded terminal straps use threaded holes which do not allow for any misalignment of parts.

Individual terminal nut retainers exist which connect with a circuit breaker. These are somewhat inconvenient to use since each one needs to be connected individually. In addition, access to the terminals is limited since additional plastic is required to give each individual nut retainer the proper support.

SUMMARY OF THE INVENTION

In an exemplary embodiment of the invention, a multipole termination connector for holding a plurality of screw apertures adjacent a plurality of terminal straps extending from a circuit breaker is disclosed. The multipole termination connector comprises a molded housing, a plurality of single-pole screw accepting members, each screw accepting member having a molded portion integrally formed with the molded housing and a screw receiving portion located on the molded portion. An aperture in preferably provided in each screw receiving portion and an attachment device preferably extends from the molded housing and is adapted to attach the multipole termination connector to a circuit breaker.

DETAILED DESCRIPTION OF THE PREFERRED EMBODIMENTS

Figure 1:
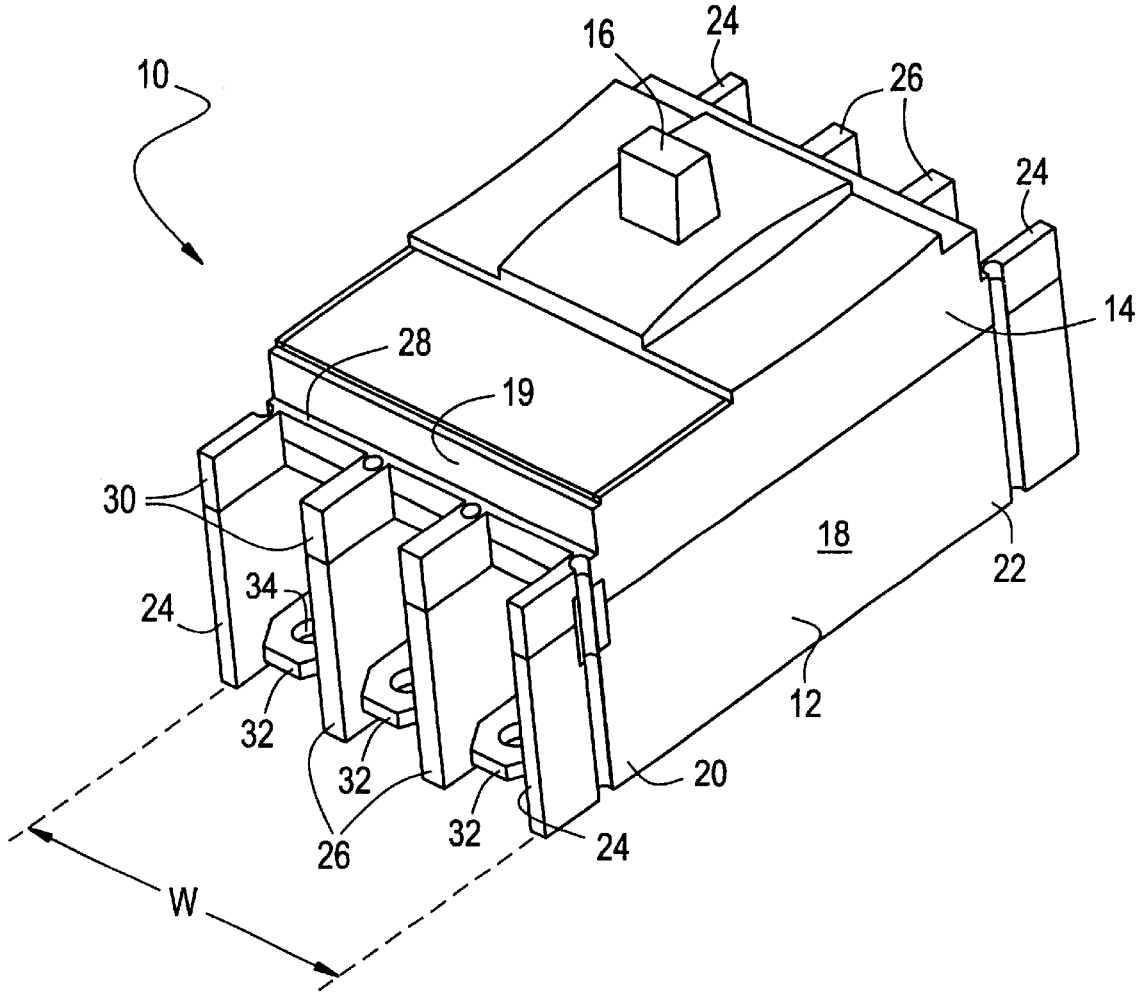
FIG. 1 shows a top perspective view of a circuit breaker for receiving the multipole termination connector of the present invention.

As shown in FIG. 1, a multi-pole circuit breaker 10 is provided with a housing 12 including a top cover 14 through which an operating handle 16 may extend. The housing 12 may be made from molded plastic. Extending from line side end 22 and load side end 20, is a plurality of upstanding walls 24, 26, each extending from the housing 12 at an attached end 28 and to a free end 30. The walls 24, 26 preferably extend substantially parallel to a sidewall 18 and substantially perpendicular to an end wall 19. Exterior walls 24 extend substantially continuously from sidewalls 18 (only one sidewall 18 shown) while spacer walls 26 are provided at equal intervals between exterior walls 24 to divide the width w between the exterior walls 24 into three substantially equal segments. It should be noted that more spacer walls 26 could be used with a greater spacing between exterior walls 24 to create more segments for additional poles in the circuit breaker if desired.

The circuit breaker 10 shown in FIG. 1 is a three pole circuit breaker and is thus provided with three terminal straps 32 extending from the circuit breaker interior. Each terminal strap 32 is provided with a screw hole 34 for accepting a screw, or equivalent rod connector, to connect the terminal strap 32 with a connector end of a source or load (not shown). The screw hole 34. in each terminal strap 32 may be oval shaped to allow for slight misalignment between the screw hole 34 and the screw hole of a nut or nut plate, which will be further described.

Figure 2:
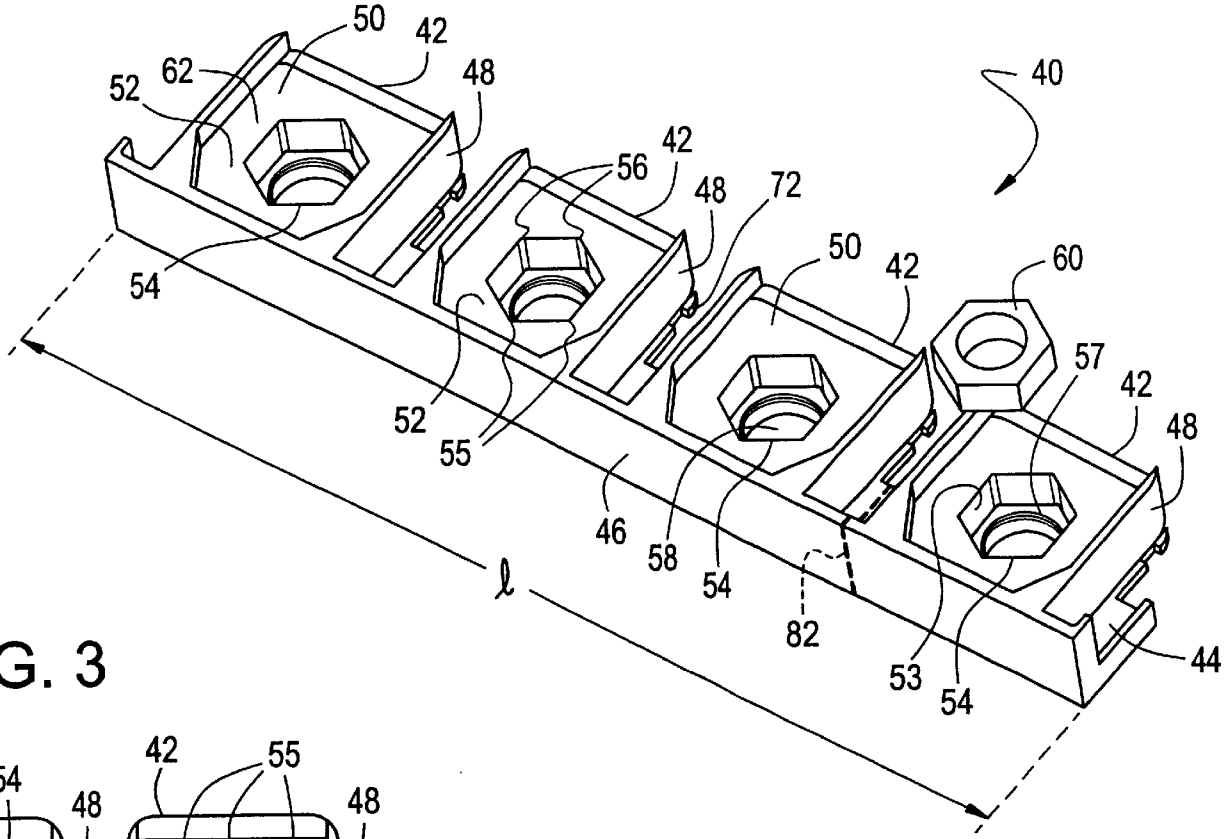
FIG. 2 shows a top perspective view of a multipole termination connector of the present invention.

In order to secure the connection of the screw to the terminal strap 32 and associated source or load connector, a multipole terminal connector 40 may be used as shown in FIG. 2. The multipole terminal connector z40 includes a plurality of single-pole screw accepting members 42 extending from a molded housing 44. The molded housing 44 is preferably molded from an insulative material such as plastic and includes a base portion 46 having a length l which is dimensionally as great or greater than the width w of the circuit breaker 10.

Figure 3:
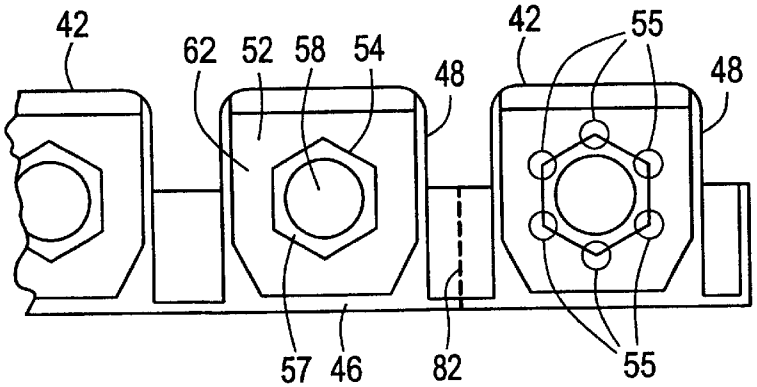
FIG. 3 shows a top plan view of the multipole termination connector of FIG. 2.

Integral with the molded housing 44 are molded portions 48 of each screw accepting member 42. The screw accepting members 42 further includes a screw receiving portion 50. As shown in FIGS. 2 and 3, the screw receiving portion 50 may include a nut receiving plate 52 which may be integrally formed with the molded portion 48. The nut receiving plate 52 includes an aperture 53 having a hexagonally shaped opening 54. The opening 54 may have one or more longitudinal ribs or bumps 56 in its corner portions 55. The bumps 56 provide the received nut 60 with a snug interference fit. The aperture 53 may further have a circular recess 58 below the hexagonally shaped opening 54 for receiving a stem of a screw (not shown). A platform 57 may be provided between the opening 54 and the recess 58 and for supporting the received nut 60.

Figure 4:
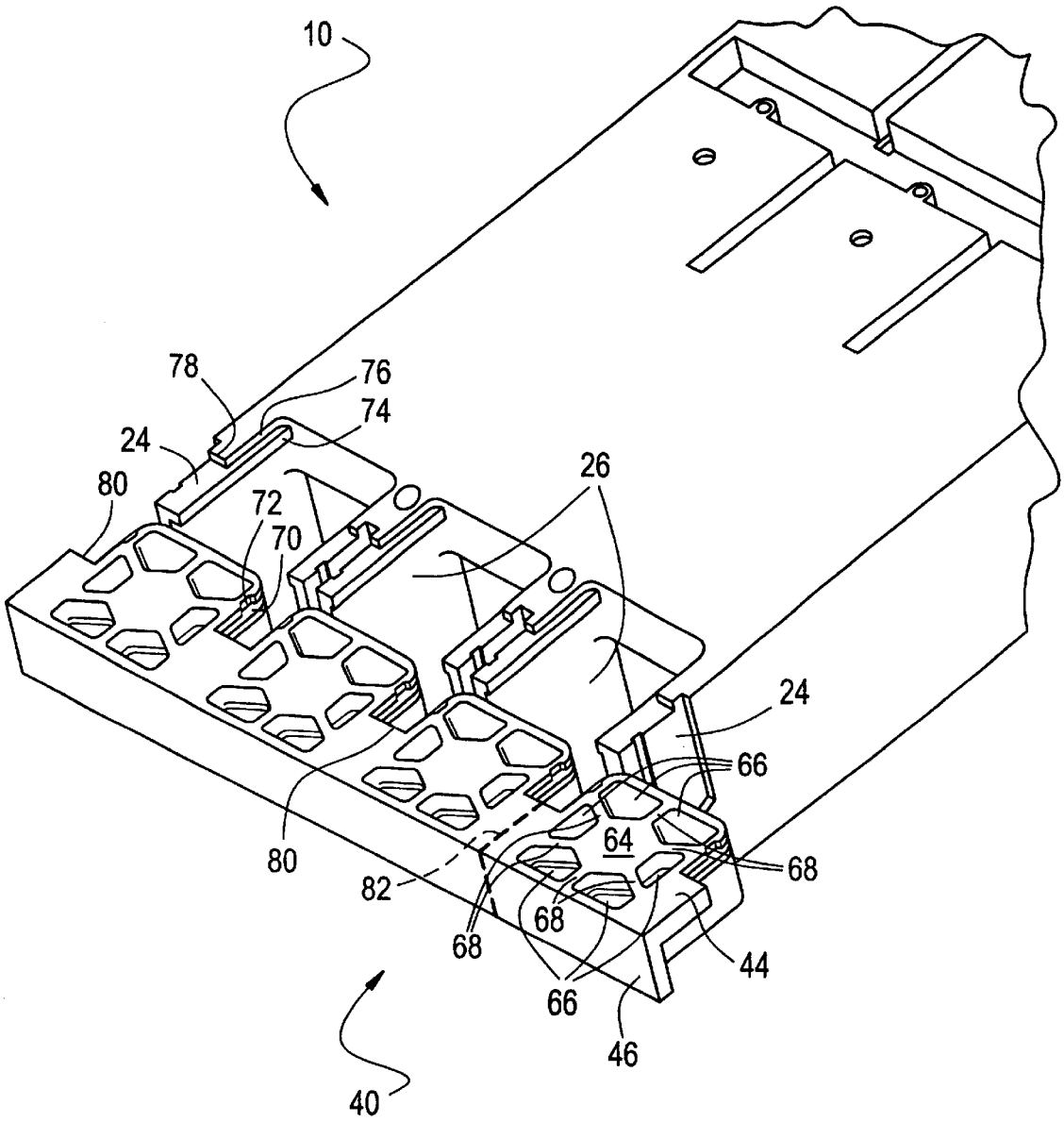
FIG. 4 shows a bottom perspective view of the multipole termination connector of FIG. 2 before attachment to the circuit breaker of FIG. 1.

The screw receiving portion 50 includes a top surface 62 and a bottom surface (not shown), with the aperture 53 extending from the top surface 62 to the bottom surface. Below the bottom surface is an electrically insulative pocket 64, a bottom portion of which is shown in FIG. 4. The electrically insulative pocket 64 prevents a received screw stem from going to ground.

As further shown in FIG. 4, the molded housing 44 may include a plurality of apertures 66, six in total, which surround the aperture 53 providing a substantially constant wall thickness of structural walls 68. This arrangement saves on plastic material while providing the necessary structural rigidity and maintaining an aesthetically pleasing appearance. A line of perforations 82 preferably extends through the molded housing 44 between at least two adjacent single pole screw receiving members 42. Thus, the multipole termination connector 40 may be molded as a unit with more than one pole where one of the poles may be broken off along the line of perforations 82 if it is not needed. For example, a four pole termination connector 40 as shown may have one of the poles broken away so that it can be used on the three pole circuit breaker 10. This arrangement allows a single termination connector mold to make parts for multiple breaker configurations. Although only one line of perforations 82 is shown, it should be understood that a line of perforations 82 could be provided between each single pole screw receiving member 42. Furthermore, although multipole termination connector 40 is shown with four poles, it is within the scope of this invention to mold the termination connector of the present invention with more or less poles.

Referring now to FIGS. 2 and 4, an attachment device for connecting the multipole terminal connector 40 to the circuit breaker 10 is shown. The attachment device may include a groove 70 and indent 72 on each side of each molded portion 48 for slidable and snap-fit engagment with a rib 74 and tab 76 protruding from each upstanding wall 24, 26. Each wall 24, 26 may be provided with a ledge 78 for abutting engagement with a stop wall 80 formed on the molded housing 44 adjacent each molded portion 48. When the multipole terminal connector 40 is to be attached to the circuit breaker 10, one single pole screw receiving member 42 is aligned for each terminal strap and then slid in the direction indicated by arrow A with the groove 70 fitting over rib 74 until the tab 76 snaps into the indent 72 which corresponds to when the ledge 78 abuts with stop wall 80.

Standard nuts for use with the present invention in its intended marketplace include both metric nuts and English nuts. One difference between a metric nut and an English nut is a slight difference in the dimension across the "flats", that is, the distance from one hexagonal side of the nut to an opposite side of the nut. Also, the threading of an English nut and a metric nut may be slightly different. In one embodiment, the bumps 56 could be provided in each comer of the hexagonal shaped opening 54 to allow for an adjusted fit for either an English nut or a metric nut.

Figure 5:
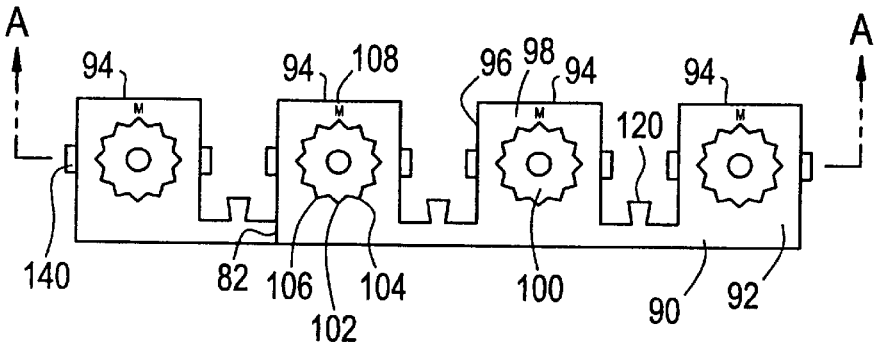
FIG. 5 shows a top plan view of a multipole termination connector of the present invention having four pole screw receiving members.
Figure 6:
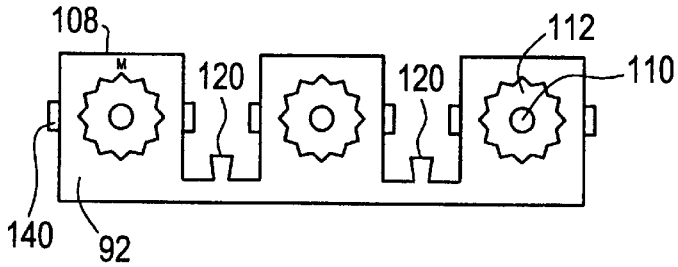
FIG. 6 shows a top plan view of the multipole termination connector of FIG. 5 with one screw receiving member removed.

In another embodiment, as shown in FIG. 5, a multipole termination connector 90 may include a molded housing 92 having a plurality of single pole screw accepting members 94 extending therefrom. The screw accepting members include a molded portion 96 integral with the molded housing 92 and a screw receiving portion 98 having an aperture 100 therein. The aperture 100 is designed to accept either English standard nut hardware or metric standard nut hardware. The aperture 100 is formed from two overlapping hexagonal recesses to receive the standard nut hardware, where the two hexagonal recesses are rotated approximately 30-degrees from each other. The resultant aperture 100 thus includes a 24 sided opening. A first hexagonally shaped opening 102 is appropriately dimensioned to receive metric standard nut hardware, and the second hexagonally-shaped opening 104 is appropriately dimensioned to receive English standard nut hardware. One of the "points" 106 of either the metric or English hexagonal recesses 102, 104 is identified in the screw receiving portion 98 by alphanumeric character 108 identifying it as being the appropriate hexagonal recess for that particular standard nut hardware. For example, as shown in FIGS. 5 and 6, the letter "M" is used to identify the hexagonally shaped opening 102 as shaped to accept metric standard nut hardware. The other hexagonal recess 104, 30-degrees rotated, would then be the appropriate hexagonal recess for the other standard nut hardware (in this case English).

Figure 8:
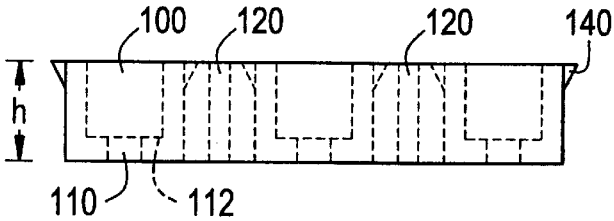
FIG. 8 shows a base side view of the multipole termination connector of FIG. 5.
Figure 9:
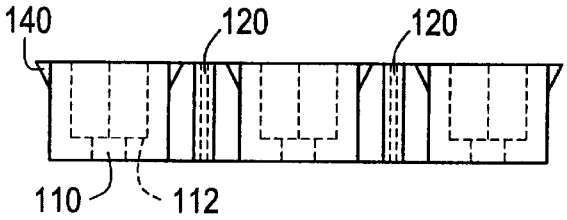
FIG. 9 shows a connecting side view of the multipole termination connector of FIG. 5.

As shown in FIGS. 8–9, the aperture 100 may further include a circular recess 110 below the 24 sided opening formed by hexagonal recesses 102, 104. The circular recess 110 may receive a stem of a screw (not shown). A platform 112 may be provided between the opening 102–104 and the recess 110 for supporting a received nut (not shown). An electrically insulative pocket may be formed below the recess 110 for preventing the screw from going to ground. In some embodiments, where the screw may need to be attached by passing the stem through first the recess 110 and then the recesses 102–104, such as when the multipole termination connector 90 is to be attached from the backside of the circuit breaker 130, the recess 110 may pass all the way through the molded portion 96 rather than having a closed electrically insulative pocket.

As with multipole termination connector 40, the multipole termination connector 90 may include at least one line of perforations 82 within the molded housing 92. Thus, a four pole termination connector as shown in FIG. 5 could easily be converted to a three pole termination connector as shown in FIG. 6 by knocking off the leftmost single pole screw receiving member 94 along the line of perforations 82 which serves as a weakened connection area.

Figure 7:
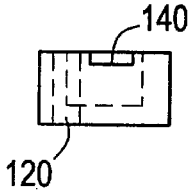
FIG. 7 shows a right end view of the multipole termination connector of FIG. 5.
Figure 11:
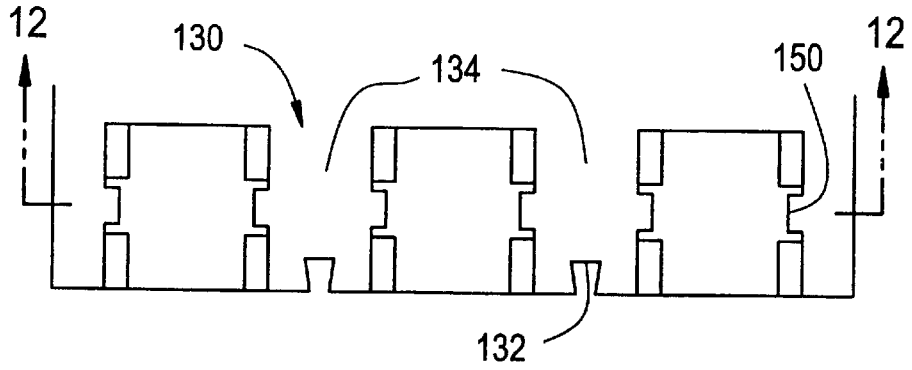
FIG. 11 shows a top plan view of a circuit breaker load or line end with the terminal straps removed.

As further shown in FIGS. 5–6, an attachment device for connecting the multipole termination conlector 90 to the circuit breaker 130 (FIG. 11) is shown as including a dovetail projection 120 extending from the molded housing 92 between each single pole screw receiving member 94. As shown in FIGS. 7–9, the dovetail projection 120 preferably extends the height h of the multipole termination connector 90. As shown in FIG. 11, the circuit breaker 130 may be provided with a correspondingly shaped dovetail recess 132 within spacer walls 134 such that the dovetail projection 120 may be slidably received within dovetail recess 132.

Figure 10:
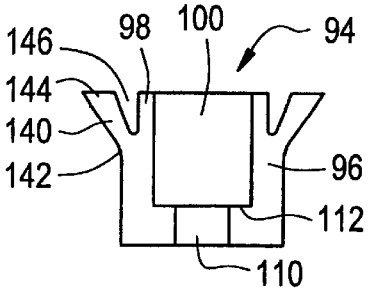
FIG. 10 shows a side cross-sectional view of a single pole screw receiving member of the multipole termination connector of FIG. 5.
Figure 12:
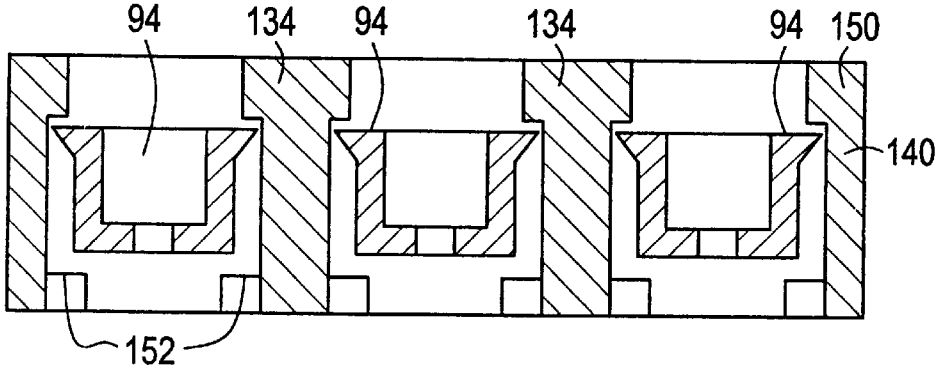
FIG. 12 shows a side cross-sectional view taken along line 12—12 of FIG. 11 with the multipole termination connector of FIG. 5 connected to the circuit breaker of FIG. 11.

An additional attachment device for connecting the multipole termination connector 90 to the circuit breaker 130 is shown in FIGS. 5–10 as flange 140. As most clearly shown in FIG. 10, flange 140 extends from the molded portion 96 at an attached end 142 to a free end 144. The free end 144 is separated from the top of the molded portion 96 and adjacent the screw receiving portion 98 by a gap 146 which may be reduced when the free end 144 is pushed towards the screw receiving portion 98. With reference to FIGS. 10–12, as multipole termination connector 90 is pushed into the circuit breaker 130 by sliding the dovetail projection 120 into dovetail recess 132, the flange 140 abuts against the projection 150 extending from spacer walls 134 and compresses until the free end passes the projection 150, at which point the flange 140 "snaps" back to its biased position shown in FIG. 10. The multipole termination connector 90 is thus retained within the circuit breaker 130. A support shelf 152 may be formed by projections extending from the spacer walls 134 to properly align the screw receiving portions 98 with the terminal straps (not shown) of the circuit breaker 130.

Figure 13:
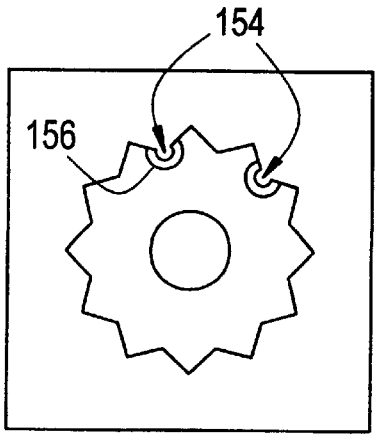
FIG. 13 shows a top plan view of a screw accepting portion of a single pole screw receiving member for use with the multipole termination connector of FIG. 5.
Figure 16:
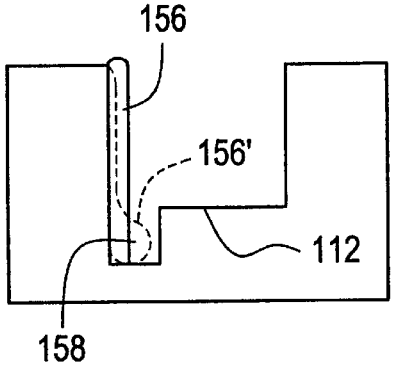
FIG. 16 shows a side cross sectional view of the single pole screw receiving member of FIG. 13.

Referring now to FIGS. 13 and 16, the aperture 100 may be provided with interference ribs 156 for providing a snug fit between the received nut and the aperture 100. As a nut (not shown) is pressed into the aperture 100, a portion of the rib or ribs 156 may be scraped off and forced downwardly. In order for the nut to maintain a proper fit against the platform 112, the debris from the scraped off portions of rib or ribs 156 must be removed from the aperture 100. As shown in FIG. 16, a clearance pocket 158 is provided directly below each rib 156 (where both rib 156 and clearance pocket 158 are exaggerated in size for clarity). Phantom line 156' indicates where the rib 156 has been scraped off and its debris or scraped off portion has been deposited within the pocket 158.

Figure 14:
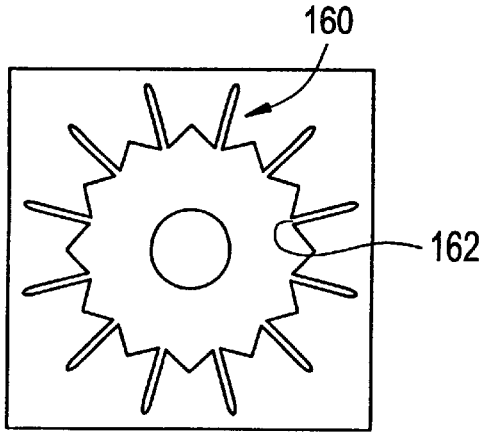
FIG. 14 shows a top plan view of a screw accepting portion of a single pole screw receiving member for use with the multipole termination connector of FIG. 5.
Figure 15:
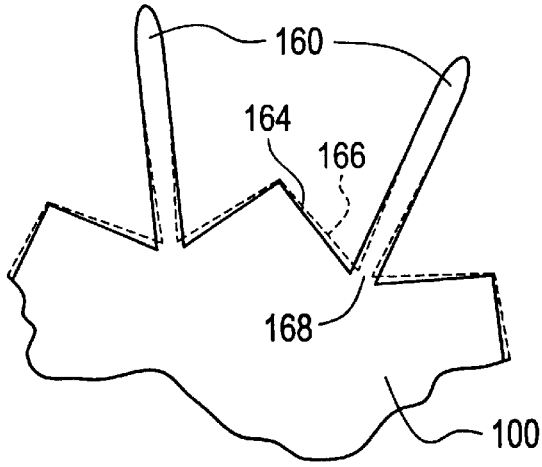
FIG. 15 shows a partial and exaggerated top plan view of the opening of FIG. 14 before and after insertion of a nut therein.

Referring to FIG. 14, one or more sawcuts 160 may extend from intersecting point s 162 between the hexagonally shaped opening 102 and hexagonally shaped opening 104. As shown in FIG. 15, when a nut is pressed into the aperture 100, the material, such as plastic, forming the connector 90 moves from the solid lines 164 to the dashed lines 166, and closing the gap 168 formed by the sawcuts 160. The sawcuts 160 thus provide a relief fit to a retained nut for preventing the material of the connector 90 from cracking.

Figure 17:
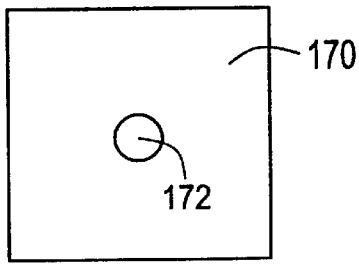
FIG. 17 shows a top plan view of a nut plate for use with the multipole termination connector of the present invention; and, FIG. 18 shows a side cross-sectional view of the nut plate of FIG. 17 within a single pole screw receiving member for a multipole termination connector of the present invention.
Figure 18:
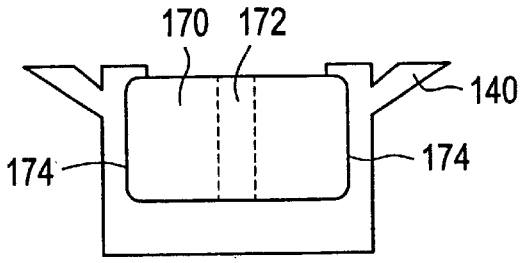

Turning now to FIG. 17, a nut plate for use with a multipole terminal connector of the present invention comprises a metallic plate 170 having a threaded opening 172. Separate nut plates could be provided for metric threads and English threads. The nut plates may then slide into grooves 174 in a single pole screw receiving member as previously described. Alternatively, the nut plates 170 could snap or press fit into a molded portion of a termination connector. The use of a nut plate 170 eliminates the need for separate standard nuts. In addition, the nut plate 170 could be provided with some leeway in movement to compensate for misalignment.

The multipole termination connectors of the present invention provides support for preventing terminal straps in circuit breakers from bending since the connector provides support under each strap. In addition the termination connector also provides structural support when installing cable or bus conductors and when torquing the terminal straps. Additionally, the mltipole termination connectors of the present invention provides support for the terminal straps under short circuit conditions where high magnetic forces are exerted between adjacent straps.

The termination connector of the present invention may be inserted from the bottom or top of the breaker. Additional variants would be to have clearance for connect on top and bottom. Clearance could either be variable or stopped by mechanical interference.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A multipole termination connector for holding a plurality of screw apertures adjacent a plurality of terminal straps extending from a circuit breaker, the multipole termination connector comprising:

a molded housing;

a plurality of single-pole screw accepting members, each screw accepting member having a molded portion integrally formed with the molded housing and a nut receiving plate located on each of the molded portions, each screw accepting member separated from an adjacent screw accepting member by an elongated opening, each elongated opening having a width sized for receiving a wall extending between a pair of adjacent terminal straps;

an aperture in each nut receiving plate, the aperture sized for snugly receiving a nut; and, an attachment device extending from the molded housing and adapted to attach the multipole termination connector to a circuit breaker.

2. The multipole termination connector of claim 1 wherein the aperture is a hexagonally shaped opening in the nut receiving plate.

3. The multipole termination connector of claim 2 wherein each hexagonally shaped opening comprises a bump in at least one corner of the opening, the bump extending within the opening and adapted to provide an interference fit with a nut received within the opening.

4. The multipole termination connector of claim 3 wherein the nut receiving plate has a top surface and a bottom surface, the screw accepting member having a clearance pocket adjacent a bottom portion of the bump, the clearance pocket adapted to catch debris from the bump when a nut is rubbed against the bump during receipt into the opening.

5. The multipole termination connector of claim 1 wherein the aperture is a pair of overlapped and offset hexagonally shaped openings in the nut receiving plate, wherein a first hexagonally shaped opening of the aperture is adapted to receive a standard metric nut and a second hexagonally shaped opening of the aperture is adapted to receive a standard English nut.

6. The multipole termination connector of claim 5 wherein the first hexagonally shaped opening is rotated approximately 30 degrees from the second hexagonally shaped opening.

7. The multipole termination connector of claim 5 wherein at least one point of the first hexagonally shaped opening or the second hexagonally shaped opening is marked with an alphanumeric character on the nut receiving plate to indicate a type of nut that may be received therein.

8. The multipole termination connector of claim 5 wherein the aperture has intersection points defined by an intersection of the first hexagonally shaped opening and the second hexagonally shaped opening, wherein at least one intersection point is provided with a saw cut radially extending into the nut receiving plate, the saw cut adapted to provide a relief fit to the nut received within the aperture.

9. The multipole termination connector of claim 1 wherein the nut receiving plate comprises a top surface and a bottom surface, the aperture extending from the top surface to the bottom surface, and wherein the molded portion includes an electrically insulative pocket adjacent the bottom surface of the nut receiving plate and surrounding the aperture, the electrically insulative pocket adapted to electrically insulate a bottom portion of a screw received within the aperture.

10. The multipole termination connector of claim 1 further comprising a line of perforations within the molded housing, the line of perforations extending between an adjacent pair of single pole screw accepting members.

11. The multipole termination connector of claim 1 wherein the attachment device comprises a dovetail retainer extending from the molded housing and between each single pole screw accepting member.

12. The multipole termination connector of claim 1 wherein the attachment device comprises an outwardly biased flange extending from the molded portion of each screw accepting member, the flange adapted to compress inwardly during connection of the multipole termination connector with a circuit breaker.

13. The multipole termination connector of claim 12 wherein the flange comprises an attached end attached to the molded portion of each screw accepting member and a free end, a gap formed between the free end of the flange and the molded portion, wherein the gap may be reduced when the free end is forced towards the molded portion.

14. The multipole termination connector of claim 1 wherein the attachment device comprises a groove within the molded portion of each screw accepting member, the groove adapted to receive a corresponding rib on the circuit breaker.

15. The multipole termination connector of claim 1 wherein the attachment device comprises an indent within the molded portion of each screw accepting member, the indent adapted to receive a corresponding tab on the circuit breaker in snap-fit relation.

16. The multipole termination connector of claim 1 wherein the molded housing comprises a base portion having a length extending a full length of the multipole termination connector.

17. A multipole circuit breaker comprising:

a plurality of terminal straps extending from one end of the circuit breaker, each terminal strap having a screw hole;

a multipole termination connector connected to the circuit breaker, the multipole termination connector comprising a molded housing, a plurality of single-pole screw accepting members, each screw accepting member having a molded portion integrally formed with the molded housing and a nut receiving plate located on the molded portion, an aperture in each nut receiving plate aligned with the screw hole in each terminal strap, each aperture in each nut receiving plate sized to snugly receive a nut, and an attachment device extending from the molded housing and attaching the multipole termination connector to the circuit breaker.

18. The multipole circuit breaker of claim 17 further comprising a circuit breaker housing; and, a wall separating each pair of adjacent terminal straps, each wall extending from the circuit breaker housing, wherein the attachment device comprises one of a groove or projection formed on the molded housing mating with a corresponding groove or projection formed on each wall.

19. The multipole circuit breaker of claim 18 wherein each wall has an attached end attached to the circuit breaker housing and a free end, the free end having a dovetail groove, and wherein the attachment device is a dovetail projection extending from the molded housing between each screw accepting member, each dovetail projection adapted to slide within a corresponding dovetail groove.

20. The multipole circuit breaker of claim 17 further comprising a circuit breaker housing; and, a wall separating each pair of adjacent terminal straps, each wall extending from the circuit breaker housing, wherein the attachment device is a groove and an indent formed within the molded portion of the screw accepting member, each wall having a mating rib and tab for receiving the termination connector in snap-fit relation.

21. The muitipole circuit breaker of claim 18 wherein each wall is provided with a shelf extending towards an adjacent wall, the shelf adapted to support the multipole termination connector.

22. The multipole circuit breaker of claim 17 wherein the screw hole in each terminal strap is oval shaped for allowing a slight misalignment between a screw hole in a terminal strap and a screw hole of a nut in a nut receiving plate.

23. The multipole circuit breaker of claim 17 further comprising a line of perforations in the molded housing of the multipole termination connector extending between an adjacent pair of single pole screw accepting members and enabling an appropriate number of single pole screw accepting members to be selected to correspond with an equal number of terminal straps by snapping off unneeded single pole screw accepting members along the line of perforations.

24. The multipole circuit breaker of claim 17 wherein the aperture is a hexagonally shaped opening in the nut receiving plate.

25. The multipole circuit breaker of claim 24 wherein each hexagonally shaped opening comprises a bump in at least one corner of the opening, the bump extending within the opening and adapted to provide an interference fit with a nut received within the opening.

26. The multipole circuit breaker of claim 25 wherein the nut receiving plate has a top surface and a bottom surface, the screw accepting member having a clearance pocket adjacent a bottom portion of the bump, the clearance pocket adapted to catch debris from the bump when a nut is rubbed against the bump during receipt into the opening.

27. The multipole circuit breaker of claim 17 wherein the aperture is a pair of overlapped and offset hexagonally shaped openings in the nut receiving plate, wherein a first hexagonally shaped opening of the aperture is adapted to receive a standard metric nut and a second hexagonally shaped opening of the aperture is adapted to receive a standard English nut.

28. The multipole circuit breaker of claim 27 wherein the first hexagonally shaped opening is rotated approximately 30 degrees from the second hexagonally shaped opening.

29. The multipole circuit breaker of claim 27 wherein at least one point of the first hexagonally shaped opening or the second hexagonally shaped opening is marked with an alphanumeric character on the nut receiving plate to indicate a type of nut that may be received therein.

30. The multipole circuit breaker of claim 27 wherein the aperture has intersection points defined by an intersection of the first hexagonally shaped opening and the second hexagonally shaped opening, wherein at least one intersection point is provided with a saw cut radially extending into the nut receiving plate, the saw cut adapted to provide a relief fit to the nut received within the aperture.

31. The multipole circuit breaker of claim 17 wherein the nut receiving, plate comprises a top surface and a bottom surface, the aperture extending from the top surface to the bottom surface, and wherein the molded portion includes an electrically insulative pocket adjacent the bottom surface of the nut receiving plate and surrounding the aperture, the electrically insulative pocket adapted to electrically insulate a bottom portion of a screw received within the aperture.

32. The multipole circuit breaker of claim 17 having a width, the terminal straps spaced apart in discrete portions along the width, wherein the molded housing of the multipole termination connector comprises a base portion having a length extending at least as long as the width of the circuit breaker.

33. A termination connector comprising:

a molded housing;

a nut receiving plate secured within the molded housing;

an aperture in the nut receiving plate, the aperture having a first hexagonal opening, the first hexagonal opening sized to receive a metric standard nut, and, a second hexagonal opening concentric with the first hexagonal opening, the second hexagonal opening sized to receive an English standard nut.

34. The termination connector of claim 33 wherein the first hexagonal opening is rotated approximately 30 degrees with respect to the second hexagonal opening.

35. The termination connector of claim 33 wherein the aperture comprises a rib in at least one corner of the aperture extending within the aperture for providing an interference fit with a received nut.

36. The termination connector of claim 34 wherein the nut receiving plate further comprises a clearance pocket adjacent a bottom portion of the rib, the clearance pocket adapted to catch debris from the rib when a nut is rubbed against the rib during its receipt into the aperture.

37. The termination connector of claim 33 wherein at least one point of the first hexagonally shaped opening or the second hexagonally shaped opening is marked with an alphanumeric character on the nut receiving plate to indicate a type of nut that may be received therein.

38. The multipole termination connector of claim 33 wherein the aperture has intersection points defined by an intersection of the first hexagonally shaped opening and the second hexagonally shaped opening, wherein at least one intersection point is provided with a saw cut radially extending into the nut receiving plate, the saw cut adapted to provide a relief fit to the nut received within the aperture.

39. A multipole termination connector for holding a plurality of screw apertures adjacent a plurality of terminal straps extending from a circuit breaker, the multipole termination connector comprising:

a molded housing;

a plurality of single-pole screw accepting members, each screw accepting member having a molded portion integrally formed with the molded housing and a nut plate located on the molded portion;

a threaded aperture in each nut plate, the threaded aperture adapted to threadably engage with threads on a screw; and, an attachment device extending from the molded housing and adapted to attach the multipole termination connector to a circuit breaker.

40. A multipole circuit breaker comprising:

a plurality of terminal straps extending from one end of the circuit breaker, each terminal strap having a screw hole;

a multipole termination connector connected to the circuit breaker, the multipole termination connector comprising a molded housing, a plurality of single-pole screw accepting members, each screw accepting member having a molded portion integrally formed with the molded housing and a nut plate located on the molded portion, a threaded aperture in each nut plate aligned with the screw hole in each terminal strap, the threaded aperture adapted to threadably engage with threads on a screw, and an attachment device extending from the molded housing and attaching the multipole termination connector to the circuit breaker.

41. A multipole termination connector for holding a plurality of screw apertures adjacent a plurality of terminal straps extending from a circuit breaker, the multipole termination connector comprising:

a molded housing;

a plurality of single-pole screw accepting members, each screw accepting member having a molded portion integrally formed with the molded housing and a screw receiving portion located on the molded portion;

a line of perforations within the molded housing, the line of perforations extending between an adjacent pair of single pole screw accepting members;

an aperture in each screw receiving portion; and, an attachment device extending from the molded housing and adapted to attach the multipole termination connector to a circuit breaker.

42. A multipole termination connector for holding a plurality of screw apertures adjacent a plurality of terminal straps extending from a circuit breaker, the multipole termination connector comprising:

a molded housing;

a plurality of single-pole screw accepting members, each screw accepting member having a molded portion integrally formed with the molded housing, and a nut receiving plate located on the molded portion;

a hexagonally shaped opening in each nut receiving plate, each hexagonally shaped opening sized for snugly receiving a nut, each hexagonally shaped opening having a bump in at least one comer of the opening, the bump extending within the opening and adapted to provide an interference fit with a nut received within the opening, the screw accepting member having a clearance pocket adjacent a bottom portion of the bump, the clearance pocket adapted to catch debris from the bump when a nut is rubbed against the bump during receipt into the opening; and, an attachment device extending from the molded housing and adapted to attach the multipole termination connector to a circuit breaker.

* * * * *

UNITED STATES PATENT AND TRADEMARK OFFICE

CERTIFICATE OF CORRECTION

PATENT NO. : 6,379,196 B1
DATED : April 30, 2002
INVENTOR(S) : Greenberg et al.

It is certified that error appears in the above-identified patent and that said Letters Patent is hereby corrected as shown below:

Title page,
Item [56], References Cited, U.S. PATENT DOCUMENTS, insert:

| | | |
|---|---|---|
| -- 5,300,907 | 4/1994 | Nereau et al … 335/172 |
| Des. 367,265 | 2/1996 | Yamagata et al ...D13/160 --. |

Column 3,
Line 4, after "connector" delete "z40" and insert therefor -- 40 --.

Column 4,
Line 66, after "termination" delete"con/ector" and insert therefor -- connector --.

Column 5,
Line 45, after "intersecting" delete "point s" and insert therefor -- points --.

Column 6,
Line 5, after "Additionally, the" delete "mltipole" and insert therefor -- multipole --.

Signed and Sealed this

Sixth Day of September, 2005

JON W. DUDAS
*Director of the United States Patent and Trademark Office*